United States Patent [19]

Jasinski

[11] 4,012,605

[45] Mar. 15, 1977

[54] INPUT/OUTPUT TRANSDUCER WITH DAMPING ARRANGEMENT

[75] Inventor: Leon Jasinski, Fort Lauderdale, Fla.

[73] Assignee: Motorola, Inc., Schaumburg, Ill.

[22] Filed: Apr. 21, 1976

[21] Appl. No.: 678,794

[52] U.S. Cl. ..... 179/180

[51] Int. Cl.[2] ..... H04R 1/28

[58] Field of Search ..... 179/102, 178, 179, 180, 179/184, 187, 188

*Primary Examiner*—George G. Stellar
*Attorney, Agent, or Firm*—Margaret Marsh Parker; James W. Gillman

[57] ABSTRACT

An improved input/output transducer having an arrangement for changing the frequency response of a small speaker when it is used as a microphone provides optimum response for both requirements. When utilized as a microphone, most of the apertures in the speaker enclosure wall are covered by a movable grille and the remaining ones are appropriately damped. This provides an acceptable frequency response with lowered sensitivity. When used as a speaker, most of the enclosure apertures are completely clear, although a small number may remain damped, providing sufficient output in speaker mode.

16 Claims, 8 Drawing Figures

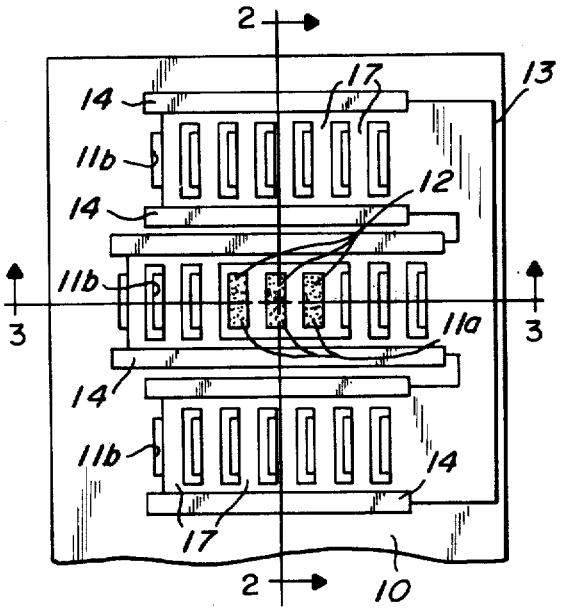
Fig. 1
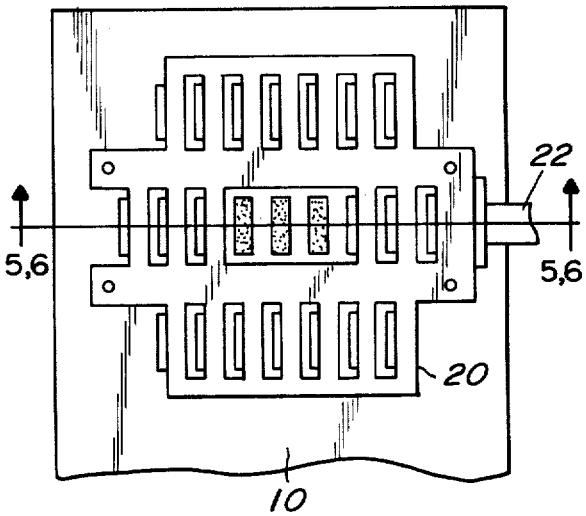
Fig. 4
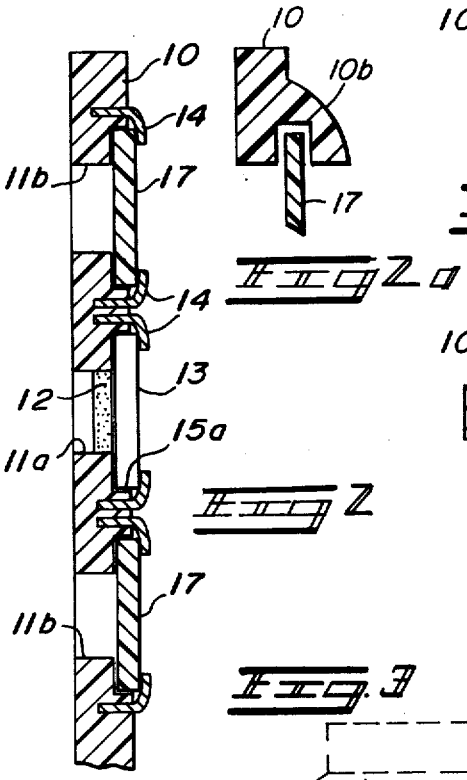
Fig. 2a
Fig. 2
Fig. 3
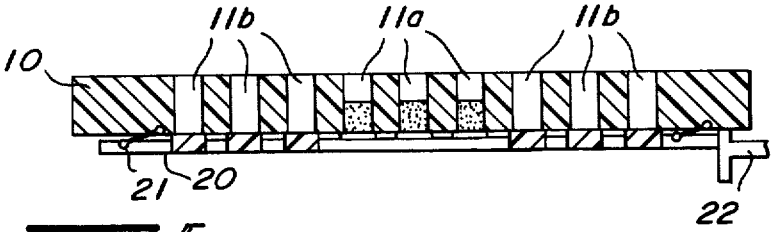
Fig. 5
Fig. 6
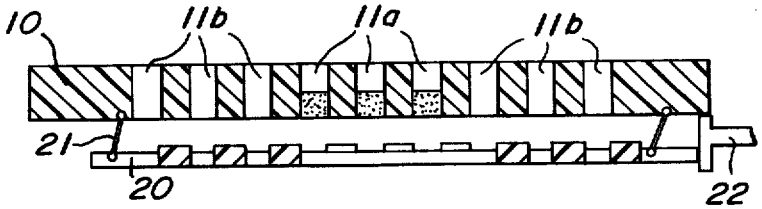
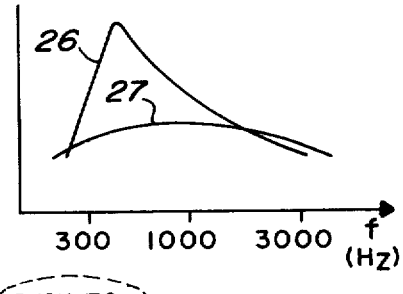
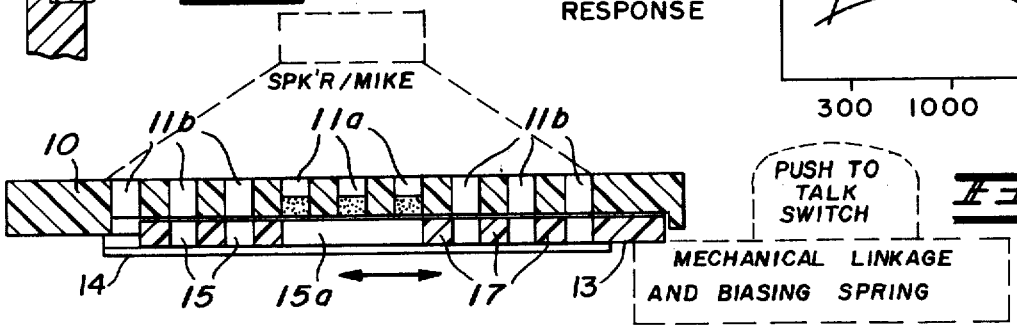
Fig. 7

INPUT/OUTPUT TRANSDUCER WITH DAMPING ARRANGEMENT

BACKGROUND OF THE INVENTION

This invention relates to the field of transducers used alternately as speakers and microphones, and particularly to an improved input/output transducer with a damping arrangement to provide optimal frequency response regardless of the operational mode.

A small inexpensive speaker of the type typically used as microphones in, for example, portable two-way communications devices, usually has peaks and valleys in its frequency response. Since such a response is acceptable in a speaker but not acceptable in a microphone, it would be desirable to damp the transducer, either electrically or mechanically, to flatten this response and this has been done in the prior art. Flattening the response, however, results in lowered audio power output which is acceptable in the speaker mode. One main reason for the differing level requirements in the two modes arises from the fact that the unit is typically held near the mouth whether the user is speaking or listening. Thus the distances to mouth and ear are quite different. A need has thus existed for a simple inexpensive means of optimizing the transducer in both modes of operation.

SUMMARY OF THE INVENTION

It is therefore an object of this invention to provide a damping arrangement for frequency response control of a transducer which is easily adjustable when the transducer is switched from speaker mode to microphone mode. It is a more particular object to provide such an arrangement which is a simple, inexpensive mechanical device.

The apparatus according to the invention includes a transducer, an enclosure for the transducer, and a grille for controlling the frequency response of the transducer in accord with the desired use. In a wall of the enclosure is a plurality of apertures arranged to permit the passage of sound waves between the transducer and the space surrounding the enclosure. The grille, supported by the enclosure and mounted adjacent the apertures in the enclosure wall, has apertures which are similar in size and arrangement to the apertures in the enclosure wall. The grille is positionable in at least two positions, and an operational control is included for positioning the grille in a first position wherein a first portion of the apertures in the enclosure wall is covered by solid segments of the grille, and for returning the grille to another position wherein the first portion of the apertures in the enclosure wall is not covered. Damping material is positioned to restrict the passage of sound waves through those enclosure apertures not covered by the grille segments when the grille is in the first position.

The grille may be moved in a plane parallel to the plane of the enclosure wall by sliding in tracks parallel to the wall surface, or the grille may be hinged to move from a spaced-apart position to a position parallel to and contacting the enclosure wall. A small number of the apertures in the enclosure may contain damping material. When only these latter apertures are not covered by grille segments, the frequency response and output level of the transducer are suitable for a microphone. When the transducer is used as a speaker, the greater number of apertures in the enclosure wall are completely open allowing easier access to the surrounding space for sound waves originating at the speaker. The damping material may remain in the small number of apertures when the transducer is operating in the speaker mode with negligible affect on either volume or quality.

BRIEF DESCRIPTION OF THE DRAWING

FIG. 1 is a front elevational view of a speaker grille arrangement constructed in accordance with the present invention.

FIG. 2 is a cutaway side view of the grille taken along the line 2—2 of FIG. 1. FIG. 2*a* is a partial similar section with integrally formed brackets.

FIG. 3 is a cutaway view of the grille taken along the line 3—3 of FIG. 1.

FIG. 4 is a front elevational view of still another speaker grille arrangement constructed in accordance with another embodiment of the invention.

FIG. 5 is a cutaway view of the grille of FIG. 4 taken along the line 5—5 and showing the apparatus in the "microphone" position.

FIG. 6 is also a cutaway view of the grille of FIG. 4, taken along the line 6—6 and showing the apparatus in the "speaker" position.

FIG. 7 is a graph of frequency response useful in understanding certain aspects of the present invention.

DETAILED DESCRIPTION OF THE INVENTION

The operating principle of the invention is that a small transducer, having satisfactory characteristics for use as a speaker in a device such as a portable two-way radio, can also be made to serve satisfactorily as a microphone by proper control of the frequency response when used in the latter mode. According to the invention, a grille formed of a rigid or semi-rigid material and having apertures similar in size and arrangement to another group of apertures in the transducer enclosure is positioned to cover or seal a large number of the enclosure apertures when the transducer is to be used as a microphone. Those apertures not covered by the grille in the microphone position are covered or filled by a suitable damping material such as a wool, metal or cellulose felt. When the transducer is used as a speaker, the apertures which were sealed by the grille are uncovered to allow the most efficient and unimpeded passage of sound waves, thus the highest level of sound.

In the embodiment of FIGS. 1–3 a portion of an enclosure wall 10 is shown with the relative position of the speaker/microphone transducer indicated by a dotted line in FIG. 3. This enclosure might contain only the speaker or an entire two-way radio (not shown), and may be of plastic, metal or other suitable material. In the wall portion 10 is an arrangement of apertures 11 of a size and position to provide adequate passage for sound waves originating at the speaker. A small portion 11*a* of the apertures 11 may contain segments of a damping material 12 as will be explained hereinafter, while a larger portion 11*b* of the apertures 11 are not filled. A grille 13, preferably formed of a rigid material such as metal or hard plastic, is slideably mounted on the enclosure wall 10 for movement in a plane parallel to the plane of the wall. Mounting may be by way of a plurality of slide brackets 14 each retaining one branch of the grille, or as shown in FIG. 2*a* by bracket means 10*b* formed integrally with the enclosure wall 10.

A simpler grille structure similar to the grille 20 shown in FIG. 4 might also be used with a single pair of retaining brackets. The preferred method of actuating the movement of the grille is by the mechanical or electromechanical means for mode switching, e.g., a mechanical linkage actuated by a push-to-talk (PTT) switch as indicated in FIG. 3, and as usually associated with such two-way apparatus. In FIG. 1, the grille 13 is shown partially covering some of the apertures 11*b*, whereas in FIG. 3, none of the apertures in the enclosure wall 10 are covered, the latter case denoting the speaker mode. All of a plurality of grille apertures 15 (FIG. 3) may be of substantially the same size, shape and arrangement as the wall apertures 11 or the grille may include a larger central aperture 15*a* (best seen in FIG. 3) in the area of the apertures 11*a* which contain damping material 12. A plurality of grille portions 17 are so disposed as to completely cover the apertures 11*b* but not the apertures 11*a* when the transducer is being used in a microphone mode. When the grille 13 is moved to the speaker mode position, all of the apertures 11 are uncovered by the grille portions 17. The damping material segments 12 may be retained in the apertures 11*a* for simplicity, as shown in FIGS. 1 and 2, but could be affixed to the grille 13 instead, if preferred, in a manner such as to cover the apertures 11*a* in at least the microphone mode. The damping material serves to improve the frequency response, prevents moisture from entering and helps reduce wind noise when the transducer is used as a microphone.

FIGS. 4–6 illustrate still another embodiment of the invention, wherein the enclosure and the apertures therein are substantially as described for the embodiment of FIGS. 1–3. Again, in FIG. 4 as in FIG. 1, the grille 20 is shown positioned between the two operative positions. FIG. 5 shows the grille in microphone mode and FIG. 6 in speaker mode. The grille 20 may be supported by hinges 21 which allow it to move from the spaced apart position of FIG. 6 to that of FIG. 5, wherein all apertures 11*b* in the enclosure wall 10 are closed or covered and only the apertures 11*a*, which contain damping material 12, can admit sound to the transducer. The structure of the hinges 21, and the location of the grille 20 in speaker mode may vary according to the methods of enabling the mode switching, which may be electromechanical or mechanical. The preferred method is the mechanical linkage actuated by a push-to-talk (PTT) switch as indicated in FIG. 3. In FIGS. 4, 5 and 6 an arm portion 22 is shown, which may be a component part of the overall actuating mechanism. Upon release of the PTT switch, the biasing spring might be utilized to return the grille to the speaker position.

FIG. 7 is a graph showing relative levels and frequency responses of a speaker used as a speaker (curve 26) and as a microphone (curve 27) when in an enclosure arrangement according to the invention. As shown in curve 26, the small, undamped dynamic loudspeaker has a normal response containing at least one large peak due to resonance. As indicated in curve 27, when the speaker is used as an input transducer and damped according to the invention, the response is considerably lower and flatter. Scales have not been given in FIG. 7 but the embodiments shown will reduce the peak response by at least 20 db in the microphone mode. In addition to the improved frequency response of curve 27, the invention reduces the sensitivity of the transducer to background noise in the microphone mode.

The two embodiments described above are exemplary only, and it is evident that other variations and modifications of the invention are possible within the spirit and scope of the appended claims.

What is claimed is:

1. An improved transducer arrangement operable in both input and output modes and adapted for use in apparatus having an enclosure with a plurality of apertures therein to permit the passage of sound waves therethrough, including in combination;

grille means having a plurality of openings and mounted on the enclosure adjacent the enclosure apertures and positioned in a first operational mode wherein said grille openings are aligned with respective ones of the enclosure apertures to permit the passage of sound waves therethrough when the transducer is in the output mode;

control means for positioning said grille in a second operational mode so as to overlie a given number of the enclosure apertures when the transducer is in the input mode;

damping means for restricting by a predetermined amount the passage of sound waves through the enclosure apertures not overlaid by said grille when in said second operational mode; and means for returning said grille to said first operational mode upon deactivation of said control means.

2. An improved transducer arrangement according to claim 1 wherein the grille means is supported for sliding motion parallel to the plane of the enclosure wall.

3. An improved transducer arrangement according to claim 2 wherein the grille means is supported by brackets affixed to the enclosure wall.

4. An improved transducer arrangement according to claim 1 wherein the damping means is retained in the given number of the apertures in the enclosure wall.

5. An improved transducer arrangement according to claim 1 wherein the damping means comprises felt.

6. An improved transducer arrangement according to claim 1 and further including a switch means for switching the operating mode of the transducer, and a linkage from the switching means to the grille positioning means.

7. An improved transducer arrangement according to claim 1 wherein the grille returning means comprises a spring.

8. An input/output transducer arrangement including a transducer, an enclosure for containing at least said transducer, a wall of the enclosure having a plurality of apertures arranged to permit the passage of sound waves between the transducer and the space surrounding the enclosure, and means for controlling the frequency response of the transducer in accord with the desired use, the control means comprising:

grille means supported by the enclosure and mounted adjacent the apertures in the enclosure wall, the grille means being positionable in at least two positions;

means for positioning the grille means in a first one of said positions wherein a portion of the apertures in the enclosure wall is covered by segments of the grille means;

means for returning the grille means to another one of said positions wherein said portion of the apertures in the enclosure wall is not covered by segments of the grille means;

damping means positioned to restrict the passage of sound waves through a second portion of enclosure apertures not covered by the grille segments when the grille is in the first position.

9. An input/output transducer arrangement according to claim 8 and wherein the grille means has a plurality of apertures similar in size and arrangement to the apertures in the enclosure wall, and the grille apertures are substantially aligned with the enclosure wall apertures when the grille is in the other of said positions.

10. An input/output transducer arrangement according to claim 8 wherein the grille means is supported for sliding motion parallel to the plane of the enclosure wall.

11. An input/output transducer arrangement according to claim 10 wherein the grille means is supported by brackets affixed to the enclosure wall.

12. An input/output transducer arrangement according to claim 10 wherein the grille means is supported by brackets integrally formed with the enclosure wall.

13. An input/output transducer arrangement according to claim 8 wherein the damping means is retained in the second portion of the apertures in the enclosure wall.

14. An input/output transducer arrangement according to claim 8 wherein the damping means comprises felt.

15. An input/output transducer arrangement according to claim 8 and further including a switch means for switching the operating mode of the transducer, and a linkage from the switching means to the grille positioning means.

16. An input/output transducer arrangement according to claim 1 wherein the grille returning means comprises a spring.

* * * * *